United States Patent [19]

Haq

[11] Patent Number: 4,884,922

[45] Date of Patent: Dec. 5, 1989

[54] FILLING CRACKS IN ARTIFICIAL AND NATURAL STRUCTURES

[75] Inventor: Ikram Haq, Clwyd, Wales

[73] Assignee: Balfour Beatty Limited, Surrey, England

[21] Appl. No.: 97,492

[22] Filed: Sep. 16, 1987

[30] Foreign Application Priority Data

Sep. 19, 1986 [GB] United Kingdom ..... 8622645

[51] Int. Cl.[4] ..... E02D 37/00; E04G 23/02

[52] U.S. Cl. ..... 405/303; 52/744; 405/269

[58] Field of Search ..... 405/258, 263, 266, 269, 405/150, 229, 303; 52/743, 744; 264/36

[56] References Cited

U.S. PATENT DOCUMENTS 3,243,962 4/1966 Ratliff ..... 405/269 X

FOREIGN PATENT DOCUMENTS 71921 5/1982 Japan ..... 405/269
1133412 1/1985 U.S.S.R. ..... 405/269
644132 10/1950 United Kingdom .

*Primary Examiner*—David H. Corbin
*Attorney, Agent, or Firm*—Thomas R. Shaffer

[57] ABSTRACT

In a simple method of filling a wide crack in an exposed surface of an artificial or natural structures, a rigid plate is positioned on the surface, which plate has on the surface of the plate nearer the surface of the structure three enclosures each bounded by an upstanding wall of compressible material. Two of the enclosures (vacuum enclosures) each has an outlet port passing through the plate and one of the enclosures (the injection enclosure) positioned between the vacuum enclosures has two injection nipples passing through the plate. The plate is so positioned on the surface of the structure that the injection enclosure overlies the crack. Air is evacuated through the outlet ports from the vacuum enclosures to cause the rigid plate to be sucked tightly against the surface of the structure and hardenable material in a semi-liquid state is pressure injected through the injection nipples into the injection enclosure until the crack is filled. The vacuum is then released, the rigid plate is removed and the hardenable material is permitted to set.

11 Claims, 2 Drawing Sheets

Figure 1:
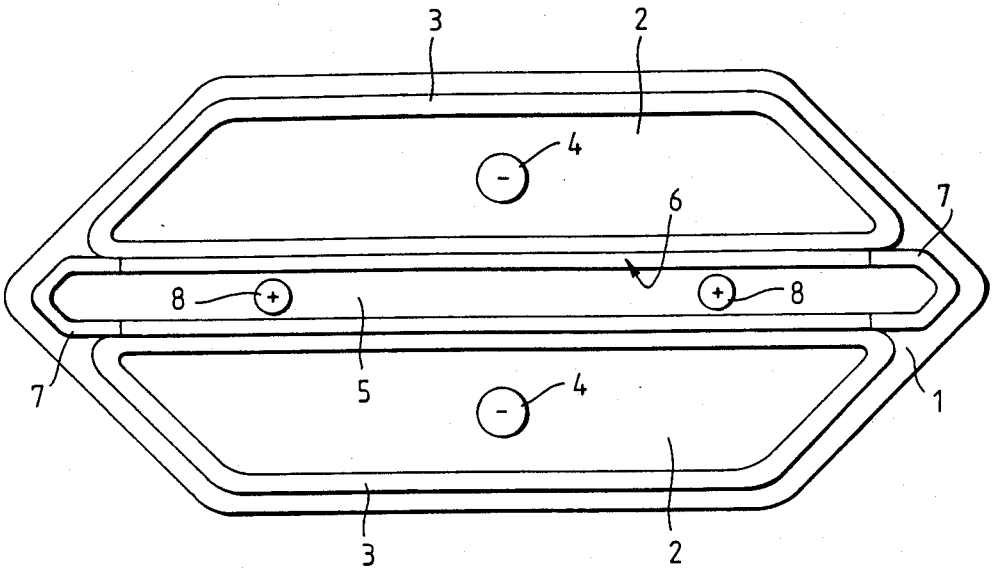

1
2
4
8
11
C
5
2
4
12
S
14
9
10

FILLING CRACKS IN ARTIFICIAL AND NATURAL STRUCTURES

This invention relates to artificial and natural structures built up of or comprising a plurality of separately formed bodies of manufactured or natural material or consisting of a single body of concrete or of rock, granite or other material in its natural state. Structures fabricated from or comprising a plurality of separately formed bodies include the walls of buildings, the abutments and piers of bridges, chimneys, brick-lined tunnels, ducts, drains and sewers, retaining walls, foundations, monuments, archaeological remains, and other structures built up of or comprising bricks, rocks, stones, granite or other building materials with or without interposed mortar or other hardenable material. Single bodies of concrete or other materials include roads, airfield runways and foundations of heavy machinery. All such artificial and natural structures will, for convenience, hereinafter be referred to as "artificial or natural structures of the kind specified".

Crumbling and similar deterioration of the material or materials of artificial or natural structures of the kind specified can be regarded as the propagation of cracks or other voids in the material that results in a complexity of interconnecting fissures. The presence of cracks or other voids in an artificial or natural structure not only lowers its strength but jeopardises the structure further should these cracks or other voids propagate. Cracks and other voids in a structure act as sources of stress and can cause high stress concentrations. Moreover, if the cracks or other voids open into a surface of the structure that is exposed to the weather, deterioration of the structure may arise from weathering. Thus, unless cracks or other voids in a structure opening into a surface of the structure that is exposed to the weather are filled to ensure that the exposed surface is rendered substantially non-porous, it may only be a question of time before the structure collapses, crumbles or otherwise fails.

It has been proposed to fill a crack opening into an exposed surface of an artificial or natural structure of the kind specified by injecting under pressure into the crack a hardenable material in a liquid or semi-liquid state through an injection nipple or injection nipples which is or are temporarily secured in the crack or which is or are held adjacent the opening of the crack during the pressure injection process.

It is an object of the present invention to provide an improved method of and improved apparatus for injecting hardenable material in a liquid or semi-liquid state into a crack or other void opening into an exposed surface of an artificial or natural structure of the kind specified.

According to the invention, the improved method comprises positioning on said exposed surface of the structure a substantially rigid plate which has on the surface of the plate nearer said exposed surface of the structure at least two enclosures each bounded by an upstanding wall of a fluid-impermeable readily compressible material, at least one of which enclosures (hereinafter referred to as the vacuum enclosure) has at least one outlet port passing through the plate and at least one of which enclosures (hereinafter referred to as the injection enclosure) has at least one injection nipple passing through the plate, the rigid plate being so positioned on said exposed surface of the structure that the injection enclosure overlies the crack or other void into which hardenable material in a liquid or semi-liquid state is to be injected; evacuating air through the outlet port or ports from the vacuum enclosure to cause the rigid plate to be sucked tightly against said exposed surface of the structure; pressure injecting hardenable material in a liquid or semi-liquid state through said injection nipple or injection nipples into the injection enclosure until the crack or other void is substantially filled with hardenable material; releasing the vacuum in the vacuum enclosure and removing the rigid plate from said exposed surface of the structure; and permitting or causing the hardenable material to set.

Where the crack or other void is greater in length than the largest dimension of the injection enclosure the improved method as hereinbefore described can be readily repeated at intervals along the length of the crack or other void by moving the rigid plate in stages along the crack or other void until the crack or other void is filled with hardenable material throughout its length.

The improved method of the present invention has the important advantage that, during pressure injection of hardenable material, the injection enclosure is substantially filled with hardenable material and hardenable material is introduced into the crack or other void substantially uniformly along the length of the crack or other void underlying the injection enclosure and not at a number of separately spaced positions.

According to a further aspect of the invention, the improved apparatus comprises a substantially rigid plate which has on one of its surfaces at least one vacuum enclosure which is bounded by an upstanding wall of a fluid-impermeable readily compressible material and which has at least one outlet port passing through the plate, and at least one injection enclosure which is bounded by an upstanding wall of fluid-impermeable readily compressible material and which has at least one injection nipple passing through the plate, the arrangement being such that when the rigid plate is so positioned on an exposed surface of the structure that the injection enclosure overlies the crack or other void into which hardenable material in a liquid or semi-liquid state is to be injected, and air is evacuated through the outlet port or ports of the vacuum enclosure or enclosures, the rigid plate will be sucked tightly against the said exposed surface of the structure and hardenable material in a liquid or semi-liquid state can be pressure injected through the injection nipple or injection nipples into the injection enclosure until the crack or other void is substantially filled with hardenable material.

Preferably, the injection enclosure is positioned between two vacuum enclosures or is surrounded by a vacuum enclosure or vacuum enclosures. Preferably, also, the injection enclosure is of an elongate shape and has at least two injection nipples at spaced positions along its length. A pressure operated cartridge gun operable from a pressure source and loaded with hardenable material in a liquid or semi-liquid state preferably is connected to the injection nipple or injection nipples. The or each outlet port of the or each vacuum enclosure preferably is connected via a vacuum line to a vacuum pump.

The upstanding wall bounding the or each vacuum enclosure and the upstanding wall bounding the or each injection enclosure preferably are each made of a cellular plastics material having a multiplicity of closed cells, e.g. neoprene foam.

The substantially rigid plate may be made of metal, e.g. aluminum, or of any other suitable material and, where it is desired to monitor progress of the injection process, it may be made of a substantially rigid transparent plastics material.

The rigid plate may be provided with a handle or handles to facilitate ready application to, movement along and removal from an exposed surface of a structure.

The rigid plate may also carry appropriate valves and/or switches for controlling the evacuation of the or each vacuum enclosure and for controlling the pressure injection of hardenable material into the or each injection enclosure.

The hardenable material employed to fill a crack or other void in an artificial or natural structure preferably comprises a thixotropic resin, e.g. a polyester or epoxy resin, or a cementitious grout.

The improved method and improved apparatus of the present invention are especially, but not exclusively, suitable for use in filling a wide crack in an exposed surface of an artificial or natural structure, i.e. a crack having a width lying in the range 2 to 15 mm.

Figure 2:
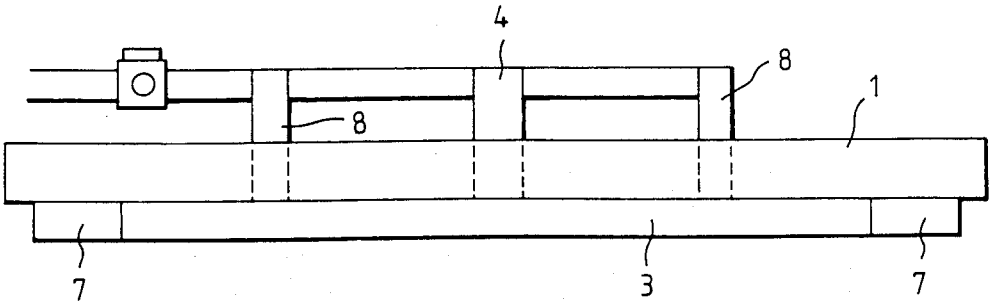
Figure 3:
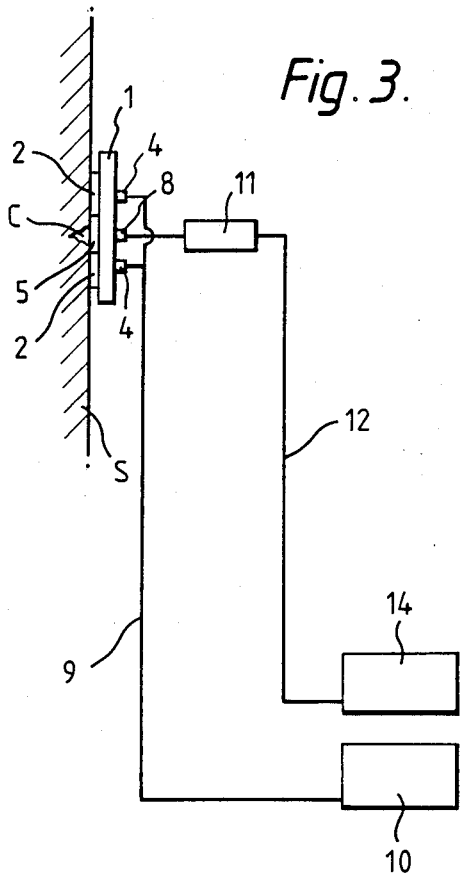

The invention is further illustrated by a description, by way of example, of the preferred apparatus for and the preferred method of injecting hardenable material in a liquid or semi-liquid state into a crack opening into an exposed surface of an artificial or natural structure of the kind specified with reference to the accompanying drawings, in which:

FIGS. 1 and 2, respectively, are diagrammatic underside and side views of the preferred apparatus, and FIG. 3 is a diagrammatic representation of the apparatus shown in FIGS. 1 and 2 being used to fill a crack in an exposed surface of a structure.

Referring to FIGS. 1 and 2, the preferred apparatus comprises a substantially rigid plate 1 of transparent plastics material which has on one of its surfaces two elongate vacuum enclosures 2 each of which is bounded by an upstanding wall 3 of a fluid-impermeable readily compressible cellular plastics material having a multiplicity of closed cells and each of which has an outlet port 4 passing through the plate. Positioned between the vacuum enclosures 2 on said surface of the rigid plate 1 is an elongate injection enclosure 5 which is bounded by an upstanding wall 6 of which end parts 7 protruding from between the vacuum enclosures are made of a fluid-impermeable readily compressible cellular plastics material having a multiplicity of closed cells, said end parts 7 and parts of the walls 3 extending alongside the wall 6 forming a periphery continuous fluid-impermeable wall bounding the injection enclosure. Two injection nipples 8 are at spaced positions along the length of the injection enclosure 5 and pass through the plate 1.

As will be seen on referring to FIG. 3, each of the outlet ports 4 of the vacuum enclosures 2 is connected via a vacuum line 9 to a vacuum pump 10. Each of the injection nipples 8 is connected to a pressure operated cartridge gun 11 loaded with hardenable material in a liquid or semi-liquid state and, via a pressure line 12, to a pressure source 14.

When using the preferred apparatus for injecting hardenable material in a liquid or semi-liquid state into a crack C opening into an exposed surface of an artificial or natural structure S of the kind specified, the rigid plate 1 is so positioned on the exposed surface of the structure that the injection enclosure 5 overlies the crack. Air is evacuated through the outlet ports 4 from the vacuum enclosures 3 to cause the rigid plate 1 to be sucked tightly against the exposed surface of the structure S. Hardenable material in a liquid or semi-liquid state is pressure injected by means of the pressure operated cartridge gun 11 through the injection nipples 8 into the injection enclosure 5 until the crack C is filled with hardenable material. The vacuum in the vacuum enclosures 2 is then released, the rigid plate 1 is removed from the exposed surface of the structure, and the hardenable material is permitted to set.

What I claim as my invention is:

1. A method of injecting hardenable material in a liquid or semi-liquid state into a void opening into an exposed surface of an artificial or natural structure, which method comprises positioning on said exposed surface of the structure a substantially rigid plate which has on the surface of the plate nearer said exposed surface of the structure at least two enclosures each bounded by an upstanding wall of a fluid-impermeable readily compressible material, at least one of which enclosures constitutes a vacuum enclosure and has at least one outlet port passing through the plate and at least one of which enclosures constitutes an injection enclosure and has at least one injection nipple passing through the plate, the rigid plate being so positioned on said exposed surface of the structure that the injection enclosure overlies the void into which hardenable material in a liquid or semi-liquid state is to be injected; evacuating air through the outlet port from the vacuum enclosure to cause the rigid plate to be sucked tightly against said exposed surface of the structure; pressure injecting hardenable material in a liquid or semi-liquid state through said injection nipple into the injection enclosure until the void is substantially filled with hardenable material; releasing the vacuum in the vacuum enclosure and removing the rigid plate from said exposed surface of the structure; and permitting or causing the hardenable material to set.

2. A method as claimed in claim 1 in which the void is greater in length than the largest dimension of the injection enclosure, wherein the method is repeated at intervals along the length of the void by moving the rigid plate in stages along the void until the void is filled with hardenable material throughout its length.

3. A method as claimed in claim 1, wherein the hardenable material is a thixotropic resin.

4. A method as claimed in claim 1, wherein the hardenable material is a thixotropic resin.

5. Apparatus for injecting hardenable material in a liquid or semi-liquid state into a void opening into an exposed surface of an artificial or natural structure, which apparatus comprises a substantially rigid plate which has on one of its surfaces at least one vacuum enclosure which is bounded by an upstanding wall of a fluid-impermeable readily compressible material and which has at least one outlet port passing through the plate, and at least one injection enclosure which is bounded by an upstanding wall of fluid-impermeable readily compressible material and which has at least one injection nipple passing through the plate, the arrangement being such that when the rigid plate is so positioned on an exposed surface of the structure that the injection enclosure overlies the void into which hardenable material in a liquid or semi-liquid state is to be injected and air is evacuated through the outlet port of the vacuum enclosure, the rigid plate will be sucked tightly against the structure and hardenable material in a liquid or semi-liquid state can be pressure injected through the injection nipple into the injection enclosure until the void is substantially filled with hardenable material.

6. Apparatus as claimed in claim 5, wherein the injection enclosure is positioned between two vacuum enclosures.

7. Apparatus as claimed in claim 6, wherein the injection enclosure is of elongate shape and has at least two injection nipples at spaced positions along its length.

8. Apparatus as claimed in claim 5, wherein the injection enclosure is surrounded by at least one vacuum enclosure.

9. Apparatus as claimed in claim 5, wherein a pressure operated cartridge gun operable from a pressure source and loaded with hardenable material in a liquid or semi-liquid state is connected to the injection nipple.

10. Apparatus as claimed in claim 5, wherein the outlet port of the vacuum enclosure is connected via a vacuum line to a vacuum pump.

11. Apparatus as claimed in claim 5, wherein the substantially rigid plate is made of a substantially rigid transparent plastics material.

* * * * *

UNITED STATES PATENT AND TRADEMARK OFFICE

CERTIFICATE OF CORRECTION

PATENT NO. : 4,884,922

DATED : December 5, 1989

INVENTOR(S) : Ikram Haq

It is certified that error appears in the above-identified patent and that said Letters Patent is hereby corrected as shown below:

Column 4, line 49, change "thixotropic resin" to --cementitious grout--.

Signed and Sealed this

Sixth Day of November, 1990

*Attest:*

HARRY F. MANBECK, JR.

*Attesting Officer*

*Commissioner of Patents and Trademarks*